US007192104B2

(12) United States Patent
Tarantik

(10) Patent No.: US 7,192,104 B2
(45) Date of Patent: Mar. 20, 2007

(54) REFRIGERATOR AND FREEZER

(75) Inventor: Peter Tarantik, Memmingen (DE)

(73) Assignee: Liebherr-Hausgeräte Ochsenhausen GmbH, Ochsenhausen (DE)

( * ) Notice: Subject to any disclaimer, the term of this patent is extended or adjusted under 35 U.S.C. 154(b) by 0 days.

(21) Appl. No.: 10/235,168

(22) Filed: Sep. 5, 2002

(65) Prior Publication Data

US 2003/0071549 A1 Apr. 17, 2003

(30) Foreign Application Priority Data

Sep. 5, 2001 (DE) ..... 201 14 654 U

(51) Int. Cl.
*A47B 96/04* (2006.01)

(52) U.S. Cl. ..... 312/405; 312/319.2; 16/266; 16/332; 16/364

(58) Field of Classification Search ..... 312/296, 312/405, 319.1, 319, 319.3; 16/361–363, 16/364, 350, 332–334, 267, 335, 342, 260, 16/262, 266; 49/386
See application file for complete search history.

(56) References Cited

U.S. PATENT DOCUMENTS 115,714 A * 6/1871 Damon et al. ..... 16/357
4,609,234 A * 9/1986 Naniwa et al. ..... 312/296
4,690,468 A * 9/1987 Lau ..... 49/386
4,753,043 A 6/1988 Bockwinkel
5,579,606 A * 12/1996 Kim ..... 49/386
5,931,554 A * 8/1999 Koopman ..... 312/405
5,975,663 A * 11/1999 Becker ..... 312/405
6,151,755 A * 11/2000 Rozema ..... 16/361

FOREIGN PATENT DOCUMENTS

| | | |
|---|---|---|
| DE | 3319757 | 3/1984 |
| DE | G9416516.5 | 12/1994 |
| DE | 4418238 | 11/1995 |
| DE | 19733132 | 4/1998 |
| DE | 20102998 | 6/2001 |
| EP | 0490928 | 6/1992 |

* cited by examiner

*Primary Examiner*—Janet M. Wilkens
*Assistant Examiner*—Hanh V. Tran
(74) *Attorney, Agent, or Firm*—Dilworth & Barrese LLP

(57) ABSTRACT

A refrigerator and/or freezer with an appliance body and a door for closing an opening of the appliance body, wherein a pivot bearing pivotably supports the door relative to the appliance body about a pivot axis. The door relative to the pivot axis and/or the pivot axis relative to the appliance body are movably mounted in the direction perpendicular to the pivot axis.

18 Claims, 12 Drawing Sheets

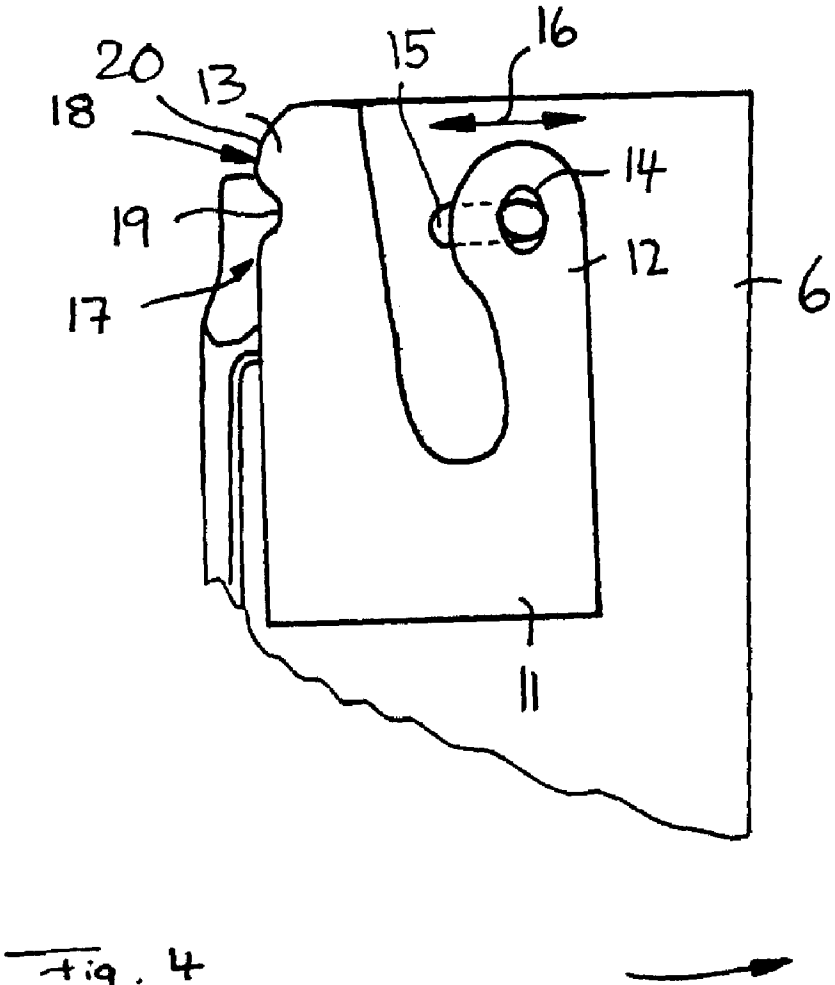
Fig. 4
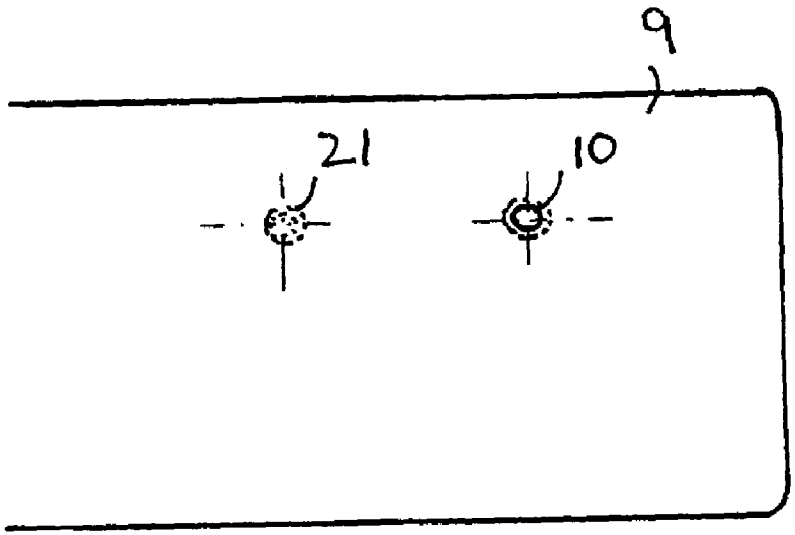

REFRIGERATOR AND FREEZER

The invention relates to a refrigerator and/or freezer with an appliance body and a door for closing an opening of the appliance body, wherein a pivot bearing is provided which pivotably supports the door relative to the appliance body about a pivot axis.

BACKGROUND OF THE INVENTION

Refrigerators and freezers generally have on their door an elastic gasket with an integrated magnet which has the function of pulling the door-side gasket bead against the sealing contact surface on the appliance body. Due to the geometric properties of such pivot doors, however, the desired optimal sealing interface is often not achieved, especially in the region of the door adjacent the pivot axis, despite obliquely positioned magnets present in the gasket profile. The magnet prematurely attracts the gasket against the appliance body such that the gasket does not seat in optimal fashion and may flex as the door continues to pivot closed. Both problems result in an unsatisfactory seal which may cause increased frost formation in the freezer space, and more generally, premature wear of the gasket.

FIG. 11 shows a refrigerator of the known type in the region of the sealing interface between pivotable door and appliance body, the door being shown in the closed position with the gasket optimally seated. The appliance body 1 has an essentially flat sealing contact surface 2 on which rests the gasket 3 attached to the door 6. As FIG. 11 shows, gasket 3 is designed as an elastic sealing bead in which a magnet 4 is integrated. This magnet pulls gasket 3 against the metal sealing contact surface 2 of appliance body 1. The optimum sealing interface shown in FIG. 11 for gasket 3 is often not achieved, however:

When door 6 is pivoted in the closing direction around the essentially vertical pivot axis 5 from the pivoted-open position, the magnet 4 first contacts sealing contact surface 2 of appliance body 1, as shown in FIG. 12. This situation also occurs if magnet 4 is positioned at an oblique angle. When door 6 continues to be pivoted in the closing direction from the position of FIG. 12, it may happen that door magnet 4 contacts appliance body 1 during the closing process due to the attractive force and cannot be moved into the optimum position during the continuing closing process by gasket 3. This sealing interface is of variable size, depending on the tolerances present. Magnet 4 seemingly prematurely attaches itself in fixed position by suction—with the result the gasket 3 flexes. FIG. 13 shows an unreliably deformed gasket 3 of this type which can only create an insufficient seal. In addition, the above-mentioned flexure of gasket 3 results in premature wear of the gasket.

SUMMARY OF THE INVENTION

The object of the invention is therefore to create an improved refrigerator or freezer of the type mentioned in the introduction in which the disadvantages of prior-art technology may be avoided and in which this technology may be further modified in an advantageous manner. Specifically, the goal is to achieve an improved opening and closing of the door with the most optimum seal possible.

This object is achieved according to the invention by a refrigerator and/or freezer described herein. Advantageous embodiments of the invention are also described herein.

According to the invention, an additional axis of motion perpendicular to the pivot axis is thus provided for the door.

The door may be movably mounted relative to the pivot axis, and/or the pivot axis may be movably mounted relative to the appliance body, in the direction perpendicular to the pivot axis. The pivot bearing is thus designed such that in addition to the rotational pivot motion of the door about the pivot axis, in the region of the pivot axis the door may be moved roughly perpendicular to the sealing interface of the appliance body away from or onto said body. This capability of translational motion transverse to the pivot axis prevents flexure of the gasket. This gasket may essentially be mounted vertically onto the opposite sealing contact surface such that it is always seated in the intended position and provides the optimum seal. Similarly, flexure is prevented when the door is opened since the additional pivot axis of the door perpendicular to the sealing contact surface allows the gasket to be pulled vertically away from the opposite sealing interface.

In a further modification of the invention, the motion of the door is controlled perpendicular to the pivot axis as a function of the pivot position of the door. A corresponding motion-control device may specifically be designed such that at the beginning of a pivot-opening process the door is initially moved essentially perpendicular to the pivot axis and thus vertically away from the appliance body; while conversely, toward the end of each pivot-closing process, the door is moved essentially perpendicular to the pivot axis, and thus perpendicular to the appliance body or its sealing contact surface and onto the latter. The translational motion superimposed on the pivot motion is thus provided in the pivot region adjoining the completely closed position of the door such that in this region the door is moved translationally essentially perpendicular to the appliance body. The conventional pure pivot motion may then be again provided in the subsequent open pivot region of the door.

Preferably, a cam device is provided perpendicular to the pivot axis, specifically in the region of the pivot axis between the appliance body and the door, to control the door motion, said cam device determining the door's distance from the appliance body as a function of the pivot position of the door. A cam may be provided with a first curve section which allows for a door position close to the appliance body, and with a second curve section adjoining the first curve section which results in a distant door position removed from the appliance body. When the door is opened, the cam presses the door in the region of the pivot axis away from the sealing interface of the appliance body. When closed, the door snaps in or falls vertically onto the sealing interface at the end of the pivot-closing process. In principle, the cam may be provided on the door or on the appliance body and rest against the opposite sliding surface. In a preferred embodiment of the invention, the cam is rigidly connected to the door so that it slides or rolls off, along with its curve control surface, on a support surface fixedly attached on the appliance body side when the door is pivoted open or closed.

Preferably, a pretensioning device, specifically a spring device, is provided to pretension the door relative to the pivot axis, or the pivot axis relative to the appliance body, in the direction of the additional axis of motion. The spring device presses the pivot axis relative to the door or relative to the appliance body into its initial position from which it is pressed out by the above-mentioned cam against the spring tension given the appropriate pivot position of the door. The pretensioning device is oriented such that when the door is closed the door is under tension toward the appliance body. The pretensioning device is appropriately dimensioned such that its pretensioning force is greater than the sealing forces in effect between door and appliance body, i.e., such that sealing forces already in effect between door and appliance body do not cause any displacement of the pivot axis, or the door to be pressed open.

The cam device and pretensioning device advantageously act together so as to effect an automatic closing of the door in the final section of the door's pivot motion. Cam device and pretensioning device together form a kind of automatic closing device. The last segment automatically swings the door shut in response to the pretensioning force and its translation by the cam device.

The additional axis of motion of the door perpendicular to the sealing contact surface of the appliance body is preferably achieved by movably mounting the door relative to the pivot axis fixed to the appliance body, and specifically in the direction transverse to the longitudinal direction of the pivot axis. In principle, is also possible, based on an approach employing a kinematic reversal, to mount the door in the conventional fashion as nondisplaceable and only rotationally movable on the pivot axis and then to arrange the latter movably relative to the appliance body in the direction perpendicular to the sealing interface of the appliance body. The preferred approach is the previously mentioned design with the pivot axis rigidly fixed on appliance body. Specifically in this regard, elongated holes may be provided on the door side in the form of bearing slots for the pivot axis, in which holes the pivot axis runs or by which the door sits on the pivot axis. The elongated-hole-shaped bearing slots extend perpendicular to the front and rear sides of the door, thereby achieving the desired motion perpendicular to the sealing interface of the appliance body.

Preferably, door arresters may be provided which sit essentially free of play and rotationally on the pivot axis, and which are pretensioned by a spring relative to the door in the direction of the door side facing away from the appliance body. The above-mentioned door arresters cause the pivot axis to be pressed preferably toward one end of the elongated-hole-shaped bearing slots of the door such that a defined position of the door relative to the pivot axis is provided whenever the cam device does not press the axis in another direction.

Door arrester and cam device preferably form one assembly unit. In one advantageous embodiment of the invention, provision may be made that one cam each is rigidly fixed to the door along with a control curve surface facing the appliance body and has a guide for one door arrester each in which the respective door arrester located on the pivot axis is displaceably routed perpendicular to the front and rear sides of the door. The pretensioning device, preferably in the form of a spring, may also be integrated into the cam. The cam may have a spring slot to accommodate the pretensioning spring.

In an alternative preferred embodiment of the invention, the cam may be rigidly fixed on the door along with a control curve surface facing the appliance body and be of an integrated one-piece design with the door arrester sitting on the pivot axis, wherein a spring section is provided between the curve control surface and the door arrester—this being achieved, for example, by having the curve control surface section and the door arrester section together define an approximately U-shaped contour. The one leg defining the door arrester may be deflected by spring action relative to the other leg of the U-shaped body which forms the rigid cam or the rigid curve control surface.

In a further modification of the invention, the pivot axis or the hinge pins are rigidly fixed to hinge plates projecting from the appliance body. The hinge plates may be attached in the conventional fashion to the appliance body or housing. Supports, specifically support pins parallel to the hinge pins, may be provided on the hinge plates on which the door-side-attached cam rests. The cam is preferably of plastic. It is useful to employ a slidable lubricating material such as polyamide. The support pins interacting with the cams at the hinge plates may be steel pins.

BRIEF DESCRIPTION OF THE DRAWINGS

The following discussion explains the invention based on preferred embodiments and associated drawings. The drawings are as follows:

FIG. 4 is an exploded plan view of a door bearing from the previous figures wherein first the door is shown with a movable guide for the pivot axis as well as a door-side-located cam, and secondly a hinge plate provided on the appliance body side is shown with the pivot axis and a support pin for the door-side cam.

DESCRIPTION OF THE PREFERRED EMBODIMENTS

Figure 1:
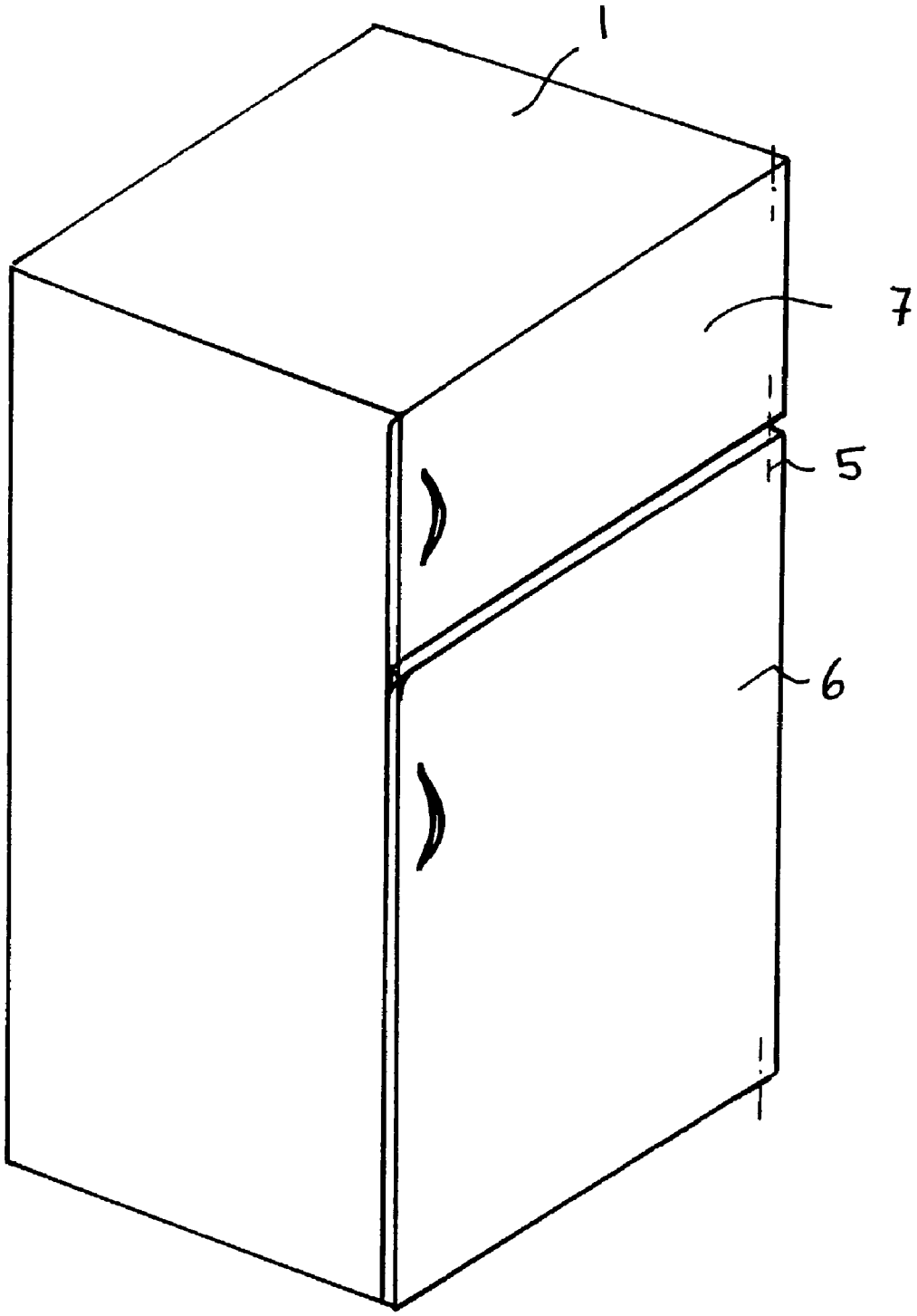
FIG. 1 is a perspective view of a refrigerator and freezer with a refrigerator door and a freezer door which are each pivotably mounted on the appliance body about a vertical pivot axis.

FIG. 1 shows a standing refrigerator and freezer which has a cubic appliance body 1, the front side of which has a refrigerator opening and a freezer compartment opening. The top-located smaller freezer compartment opening is closed by a freezer compartment door 7, while the bottom large refrigerator opening is closed by the refrigerator door 6.

Both doors 6 and 7 and are pivotable about a vertical pivot axis which is located on the right side of the refrigerator and freezer as shown in FIG. 1.

Both doors here have a top bearing and a bottom bearing which together define the pivot axis 5. The top and bottom bearing of each door 6 and 7 may be designed analogously, and consequently the following discussion describes only the top bearing of refrigerator door 6.

Figure 2:
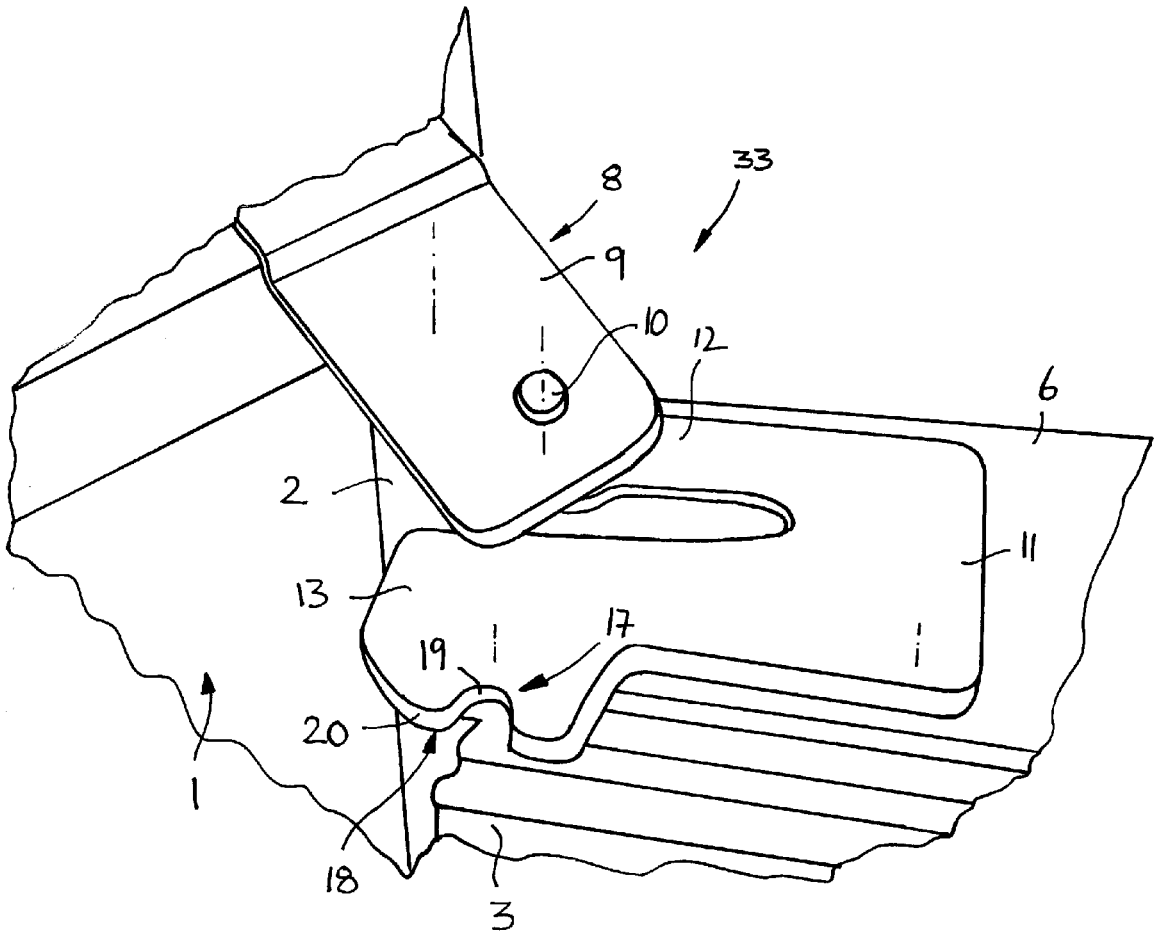
FIG. 2 is a perspective view of a top bearing of the refrigerator door of FIG. 1 in a sectional view from above based on a preferred embodiment of the invention.
Figure 3:
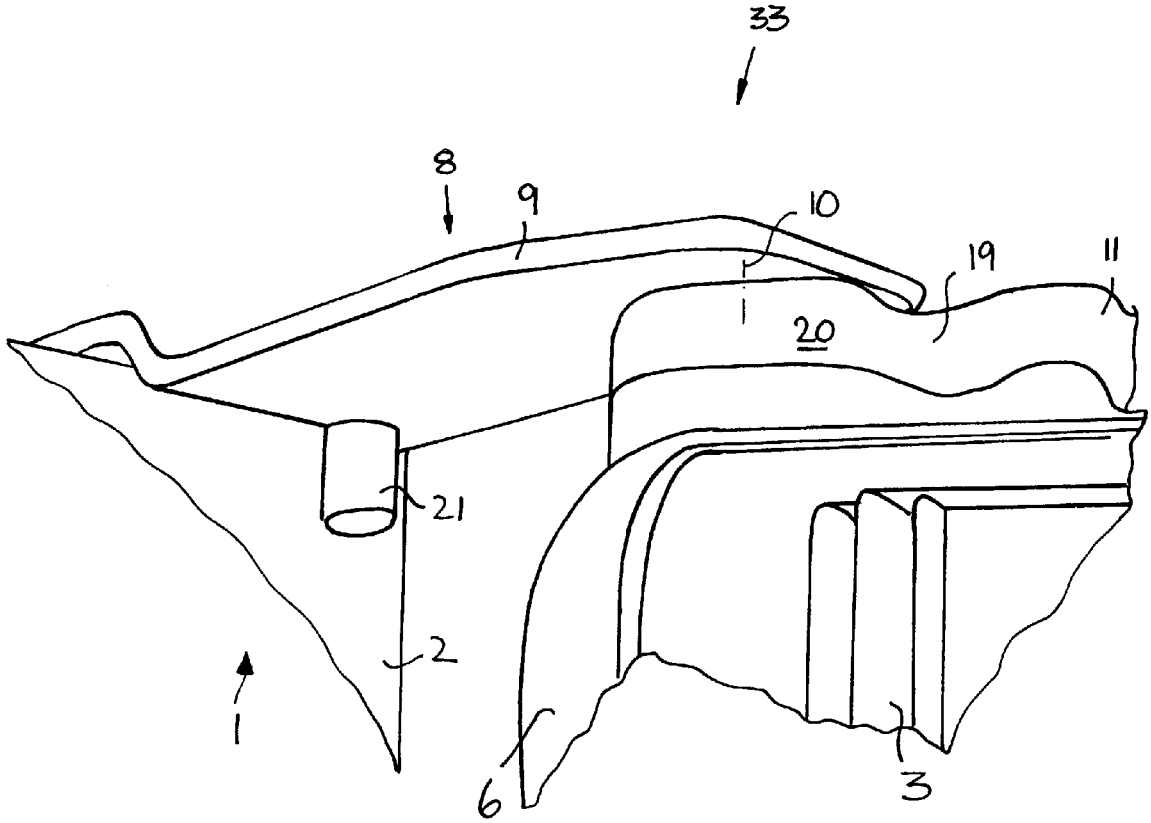
FIG. 3 is a perspective view of a door bearing from FIG. 2 as seen obliquely from below.

FIGS. 2 and 3 provide a perspective view of the top bearing of refrigerator door 6. A bearing bracket 8 in the form of a hinge plate 9 projects from the appliance housing or body 1, the bracket overlapping door 6 on its top side. A hinge pin 10 projecting downward is rigidly fixed to hinge plate 9, the hinge plate along with the corresponding hinge pin of the lower bearing of door 6 defining pivot axis 5. Hinge pin 10 may be fastened by screws or welded on to hinge plate 9, or attached by an analogous method.

An essentially plate-type door arrester 11 with an essentially U-shaped contour is fastened to the top side of door 6. Specifically, door arrester 11 along with its one leg is rigidly connected to the top side of door 6, specifically screwed to it, while the other leg of door arrester 11 does not have a fixed connection to the surface of the door. Door arrester 11 is composed of an elastic material, specifically a flexible plastic, so that the free door arrester leg 12 may move flexibly relative to the door. Door arrester 11 is arranged such that the recess between legs 12 and 13 runs parallel to the front and rear sides of the door. As a result, free door arrester 12 is able to move or function elastically essentially perpendicular to the front and rear side of door 6.

As FIG. 2 shows, hinge pin 10 of bearing bracket 8 engages the elastic or movable leg of door arrester 11. Door arrester 11 has a hinge pin slot 14 on door arrester leg 12, which slot accepts hinge pin 10 (see FIG. 4). Hinge pin 10 passes through door arrester 11 and then passes within an elongated-hole-type bearing slot 15 provided on the top side of door 6. The elongated hole 15 extends along its longitudinal axis essentially perpendicular to the front and rear sides of the door such that door 6 is able to move perpendicular to its front and rear sides relative to pivot axis 5. To explain it from the reverse point of view, hinge pin 10 can be moved back and forth within elongated hole 15, where each door arrester leg 12 moves elastically in tandem. Door arrester leg 12 is arranged such that hinge pin 10 is pressed into that end of elongated slot 15 which lies toward the outside of door 6. The mobility of the door relative to the hinge pin, and visa versa, is indicated in FIG. 4 by the arrow 16. Door arrester 11 thus simultaneously forms a pretensioning or spring-like device which pretensions pivot axis 5 and door 6 in a predefined position relative to each other.

In an alternative inventive design, not shown separately, it would also be possible to dispense with the elongated-hole design 15 and to guide hinge pin 10 exclusively with door arrester leg 12. In this case, hinge pin slot 14 in door arrester 11 would sit essentially free of play and concentrically on hinge pin 10. Mobility would then not be provided by elongated hole 15 but by the elastic motion of door arrester leg 12. Stops may be used to limit the maximum deflection of door arrester leg 12 in the direction of arrow 16.

As FIGS. 2 and 4 show, the door arrester section 13 rigidly fixed to the top side of the door forms a cam 17 projecting toward the door interior or appliance body 1, which cam has a curve control surface 18 on its side facing appliance body 1. Curve control surface 18 essentially consists of a first section in the form of a sink 19 and a second section contiguous with it in the form of a convex camber 20 projecting with the door closed toward appliance body 1, which camber forms a door opening section or functions as a door opener.

Interacting with cam 17 is a support pin 21 which is rigidly fixed and projects parallel to hinge pin 10 on bearing bracket 8 (see FIG. 3). The peripheral surface of support pin 21 forms a sliding surface on which curve control surface 18 of cam 17 is able to slide.

Figure 5:
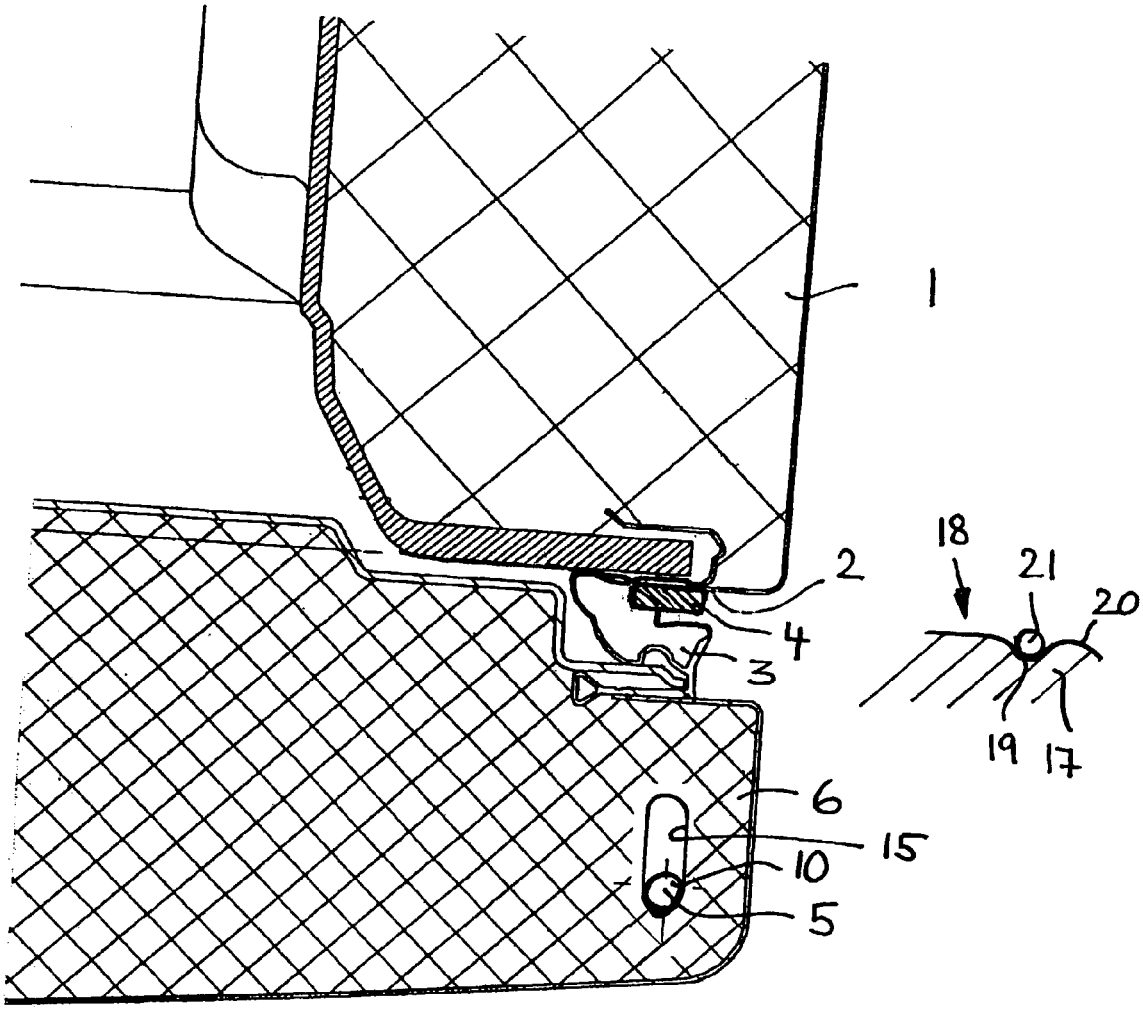
FIG. 5 shows a horizontal section through the refrigerator and freezer of FIG. 1 in the region of the seal between appliance body and door wherein the door is shown in a completely closed position.

Curve control surface 18 of cam 17, and support pin 21 are arranged and dimensioned relative to one another such that with the door completely closed, support pin 21 contacts sink 19 of cam 17 with a snug fit. This configuration is shown in FIG. 5, specifically in segment a). With door 6 in the completely closed position, a seal extending circumferentially around the interior side of the door in the form of an elastic gasket bead 3 contacts the sealing contact surface 2 facing the door of appliance body 1. As FIG. 5 shows, gasket 3 may include a magnet 4 in the conventional manner which attracts the metallic appliance housing surface or exterior side of body 1, thus effecting a secure tight contact between sealing contact surface 2 and gasket 3.

Figure 6:
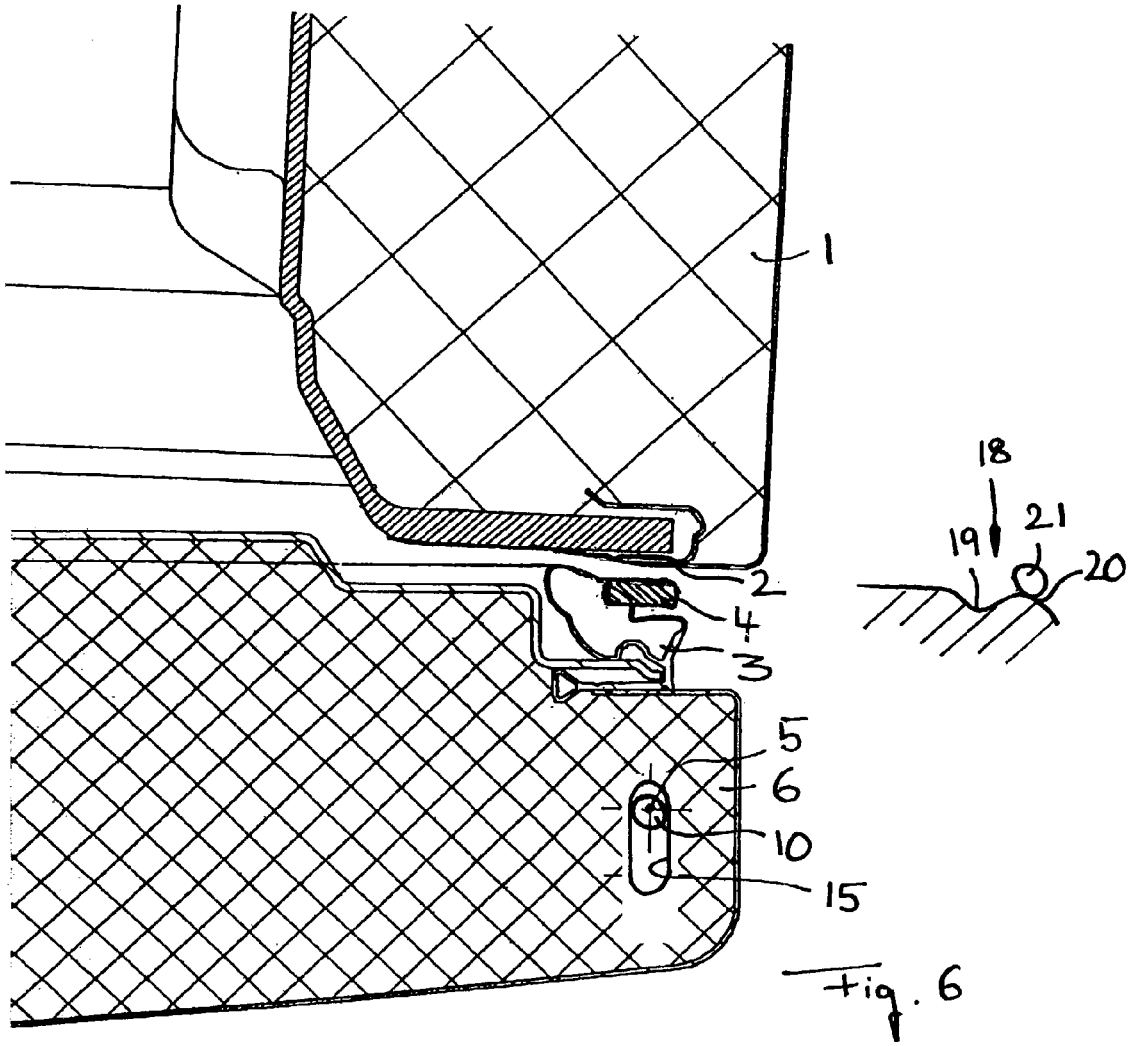
FIG. 6. shows a section through the refrigerator and freezer similar to FIG. 5 wherein the door is shown in a position which is slightly pivoted open and raised vertically from the appliance body.

When door 6 is pivoted open from the closed position, curve control surface 18 of cam 17 with its camber 20 projecting toward sealing contact surface 2 must move over support pin 21. FIG. 6 shows this specifically in segment a). Since cam 17 is rigidly connected to door 6, this bumping of cam 20 against support pin 21 presses door 6 essentially vertically away from sealing contact surface 2. In the process, gasket 3 is lifted essentially deflection-free from sealing contact surface 2. The hinge axis or hinge pin 14 then moves within elongated hole 15, as FIG. 6 shows, against the spring resistance of the pretensioning device. Door arrester leg 12 here is flexed toward the fixed door arrester leg 13.

Figure 7:
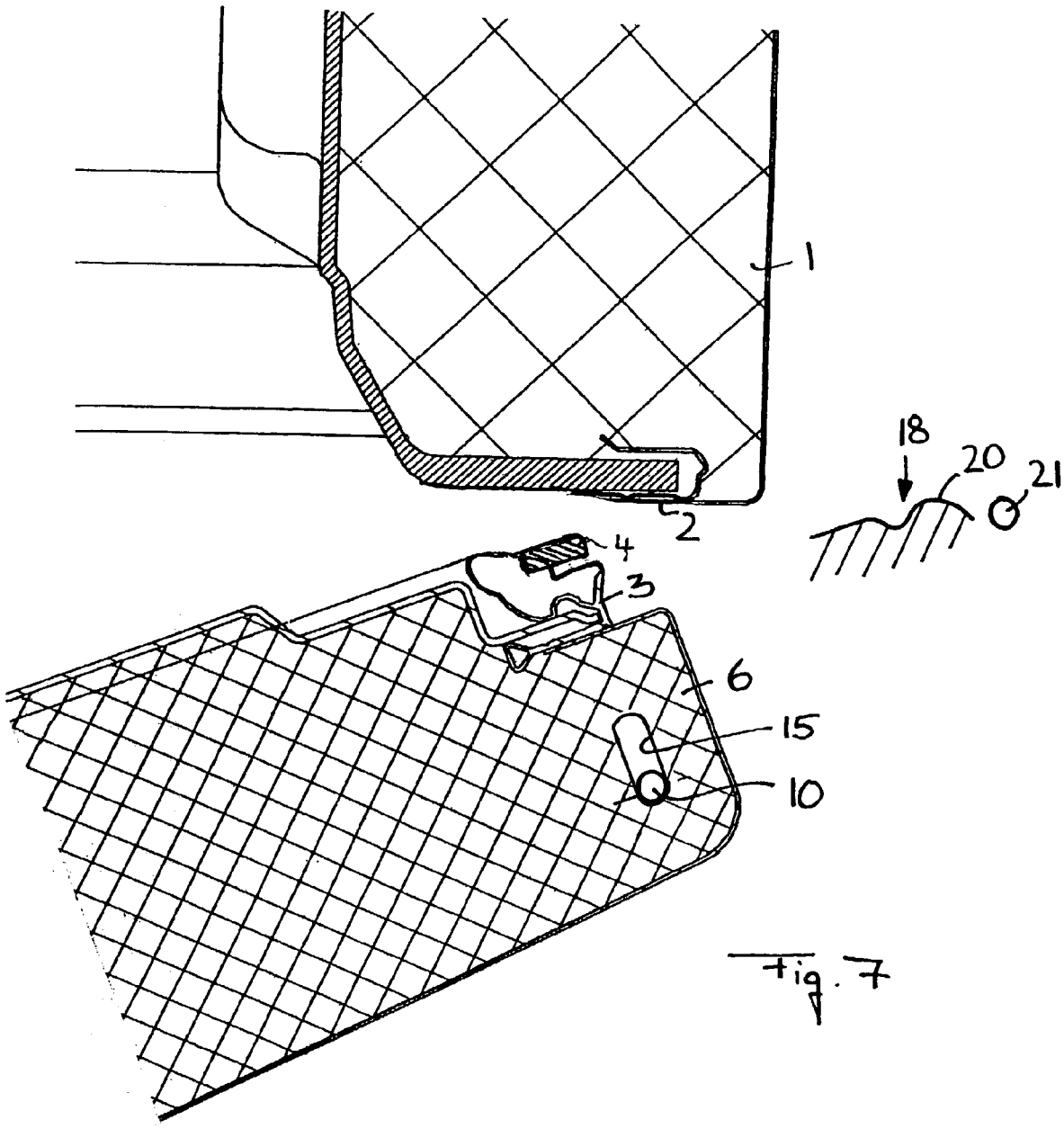
FIG. 7 shows a horizontal section through the refrigerator and freezer similar to FIGS. 5 and 6 wherein the door is shown in a position pivoted further open.

As the door is opened further, curve control surface 18 moves further along support pin 21. Camber 20 retracts so that the spring pretensioning device of elastic door arrester 11 is able to press door 6 back into its initial position relative to hinge pin 14. This is shown in FIG. 7. As soon as pivot axis 5 again assumes its initial position relative to the door, the superimposition of the translational motion of the door perpendicular to pivot axis 5 has ended. When the door is pivoted further open, the door again undergoes a purely rotary motion of the conventional type. When pivoted back to the closed position, the door undergoes a correspondingly reverse motion. Specifically, gasket 3 along with its magnet 4 does not remain prematurely caught on sealing contact surface 2; instead gasket 3 moves essentially vertically onto sealing contact surface 2 only toward the end of the closing motion, and specifically when cam 17 along with its sink 19 snaps onto support pin 21. In the process, an automatic closing motion occurs effected by the spring pretensioning of elastic door arrester 11, which motion pulls the door completely shut.

The spring pretensioning device attempts to press support pin 21 into sink 19 in order to obtain a lower energy level for the system.

Other embodiments are also possible in place of the integrated one-piece and elastic spring-action design of door arrester 11.

Figure 8:
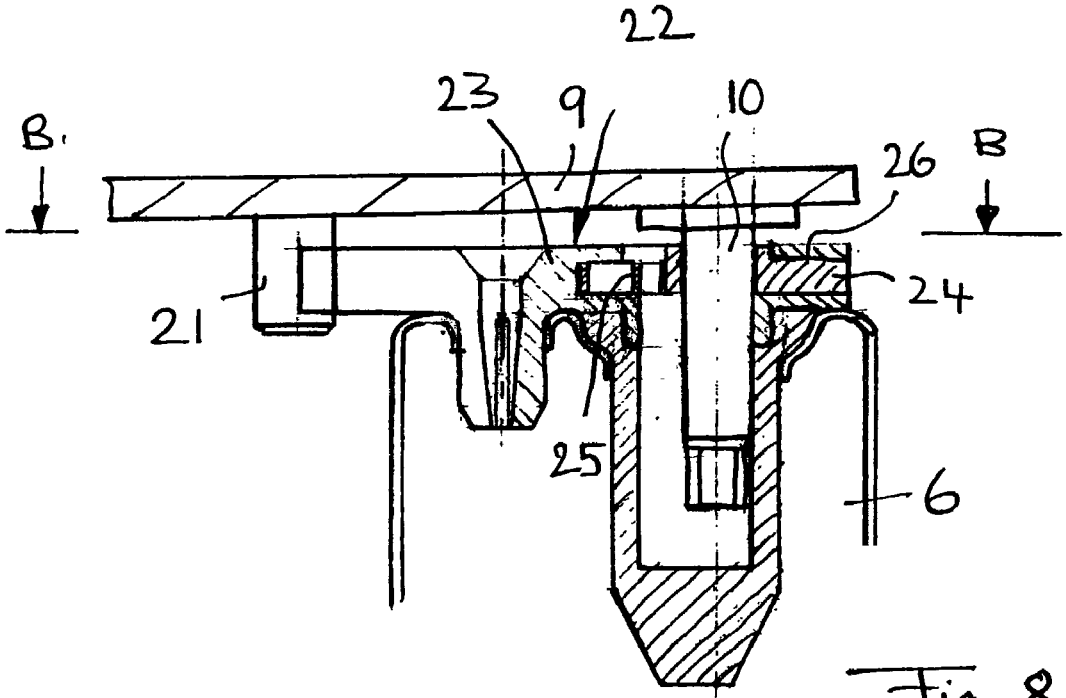
FIG. 8 shows a longitudinal section through a top bearing of the door of the refrigerator and freezer of FIG. 1 based on another preferred embodiment of the invention, specifically along line A—A in FIG. 9.
Figure 9:
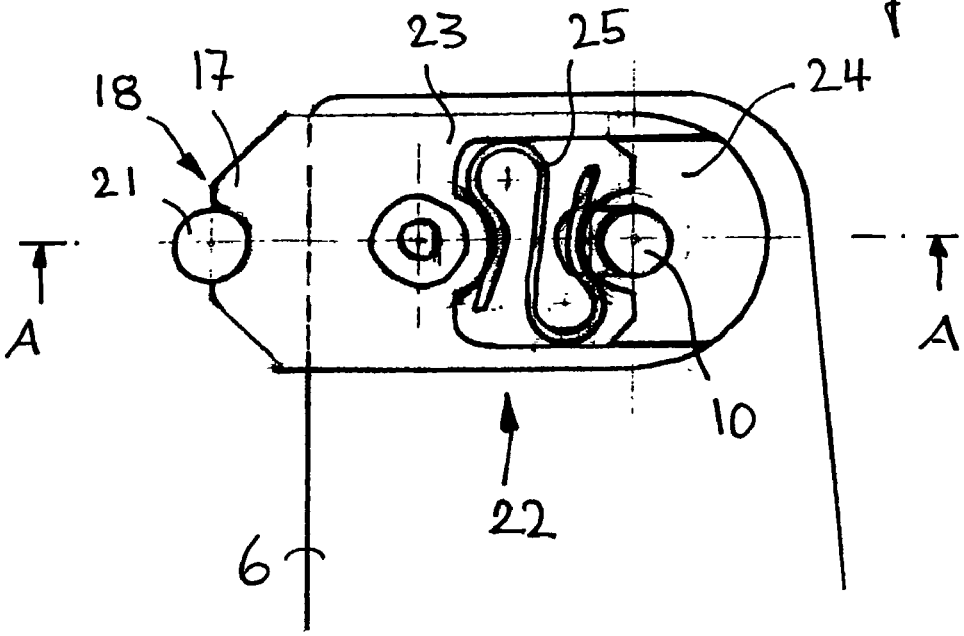
FIG. 9 is a plan view of the top bearing of FIG. 8, specifically along line B—B of FIG. 8.

FIGS. 8 and 9 show another embodiment of this type. Here again the hinge pin 10 is routed within an elongated-hole-shaped bearing slot 15 in the top side of door 6. Elongated-hole-shaped bearing slot 15 also extends perpendicular to the door interior and exterior sides, thereby achieving the corresponding motion already described. Here, however, door arrester 22 is of a multi-part design. A first door arrester section 23, the side of which facing the appliance body is designed as cam 17, is rigidly fixed on the top side of door 6. First section 23, essentially of a plate-like design, has on its side facing the door exterior a drawer-like slot 26 in which the second door arrester section 24 is displaceably mounted and is located. Slot 26 extends along its longitudinal axis parallel to elongated-hole-shaped slot 15 within the top side of door 6 such that second door arrester section 24 is reciprocally slidable within first door arrester section 23 transversely relative to hinge pin 10, or with the door closed, essentially perpendicular to sealing contact surface 2. A spring 25 presses second door arrester section 24 toward the outside of door 6. Here a stop, which may be formed by a stage of slot 26, defines an end position of second door arrester section 24 in which this section is pretensioned.

A circular hinge pin slot 14 is provided in second door arrester section 24, with which slot second door arrester section 24 sits on hinge pin 10 (FIG. 8).

In order to move the door perpendicular to pivot axis 5, spring 25 is deformed accordingly, specifically compressed as in FIG. 9. Here second door arrester section 24 moves deeper into drawer-like slot 26 within first door arrester section 23. Pivot axis 5 moves toward the interior side of the door. In this design too, the motion between pivot axis 5 and door 6 is controlled transversely relative to the pivot axis as a function of the pivot position of the door. Cam 17 acts in analogous fashion, and so reference is made here to the previous description.

Figure 10:
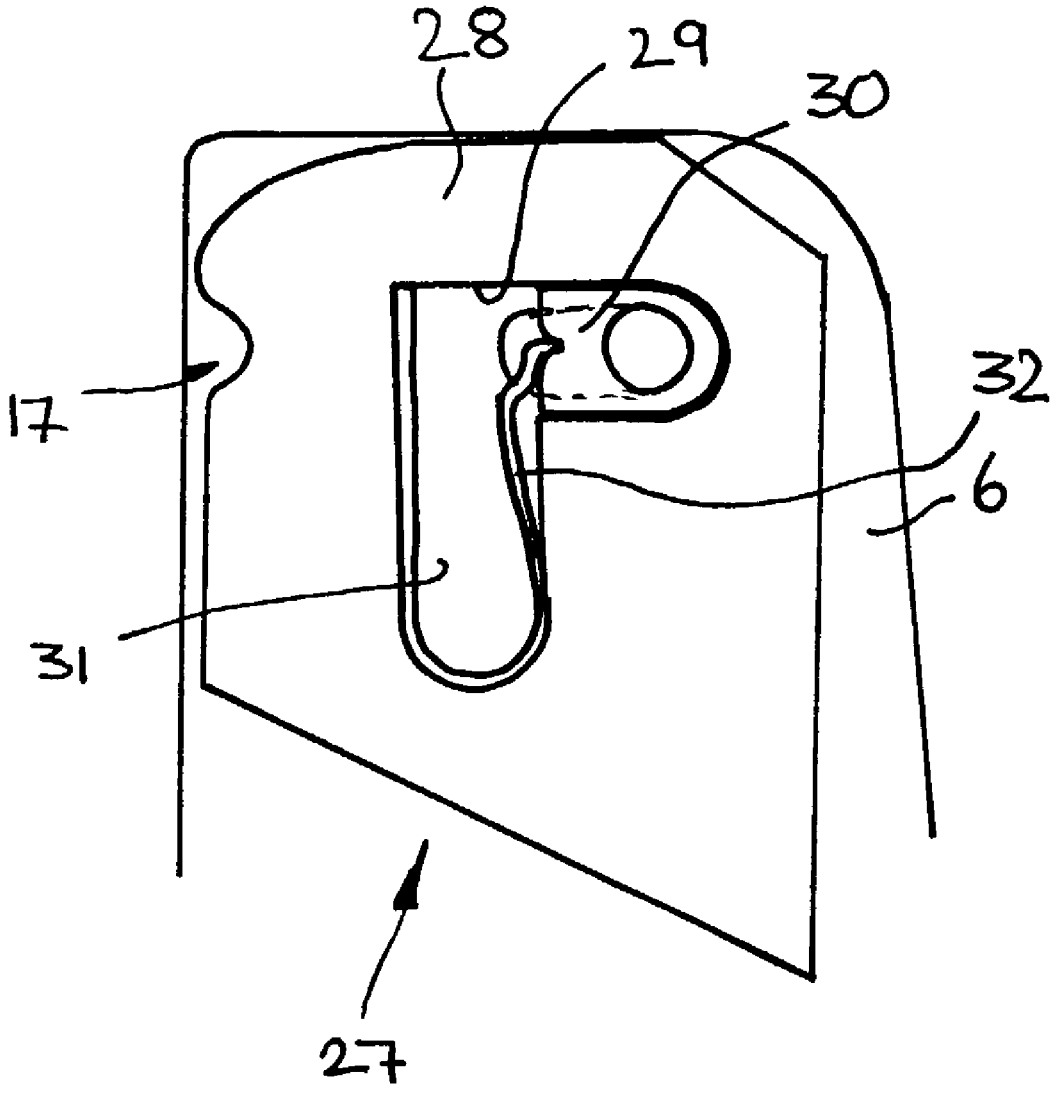
FIG. 10 is a plan view of a top door bearing of the refrigerator and freezer of FIG. 1 based on another preferred embodiment of the invention.
Figure 11:
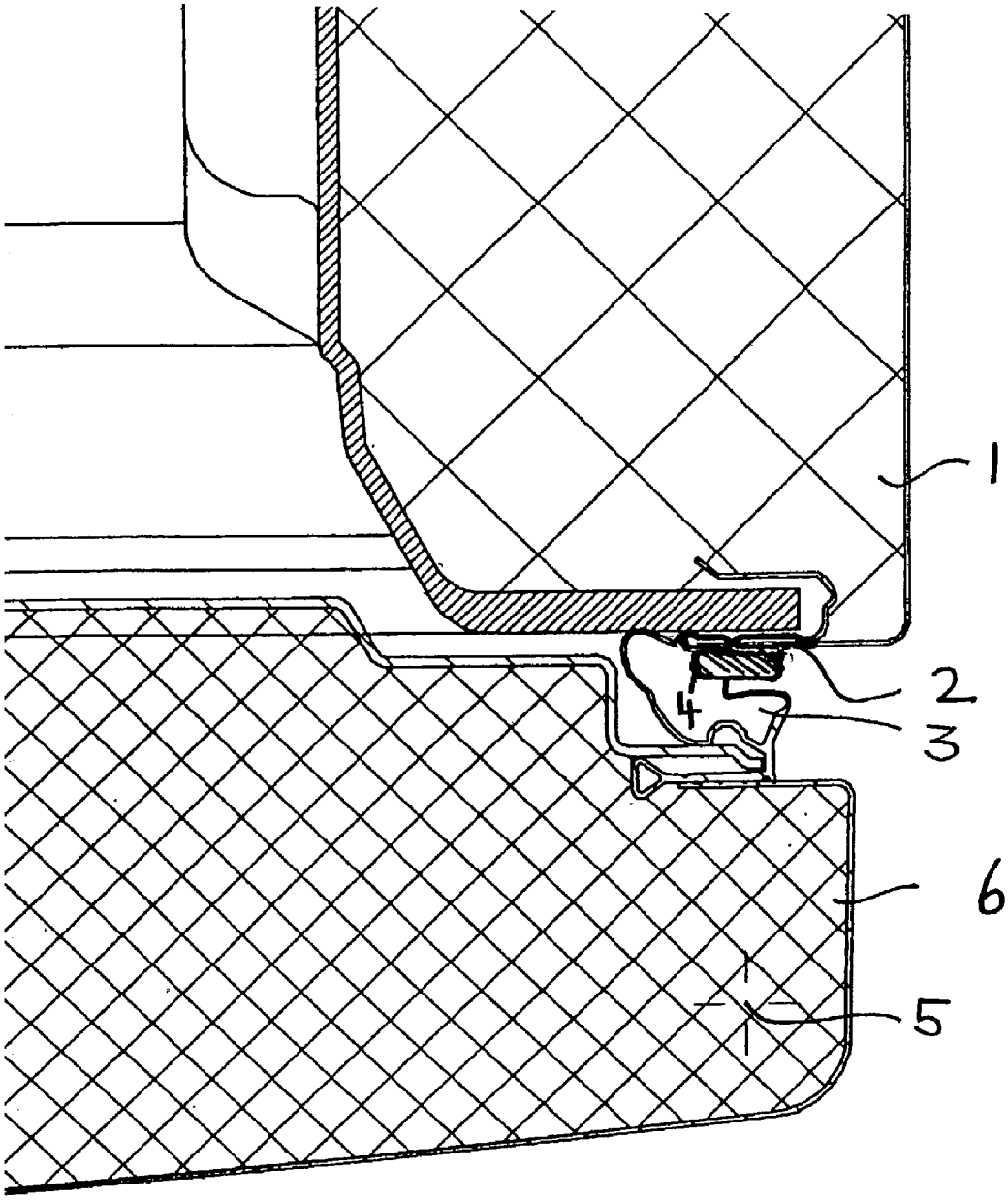
FIG. 11 shows a horizontal section through a refrigerator in the region of the seal between door and appliance body based on prior art in which a fixed pivot axis is provided.
Figure 12:
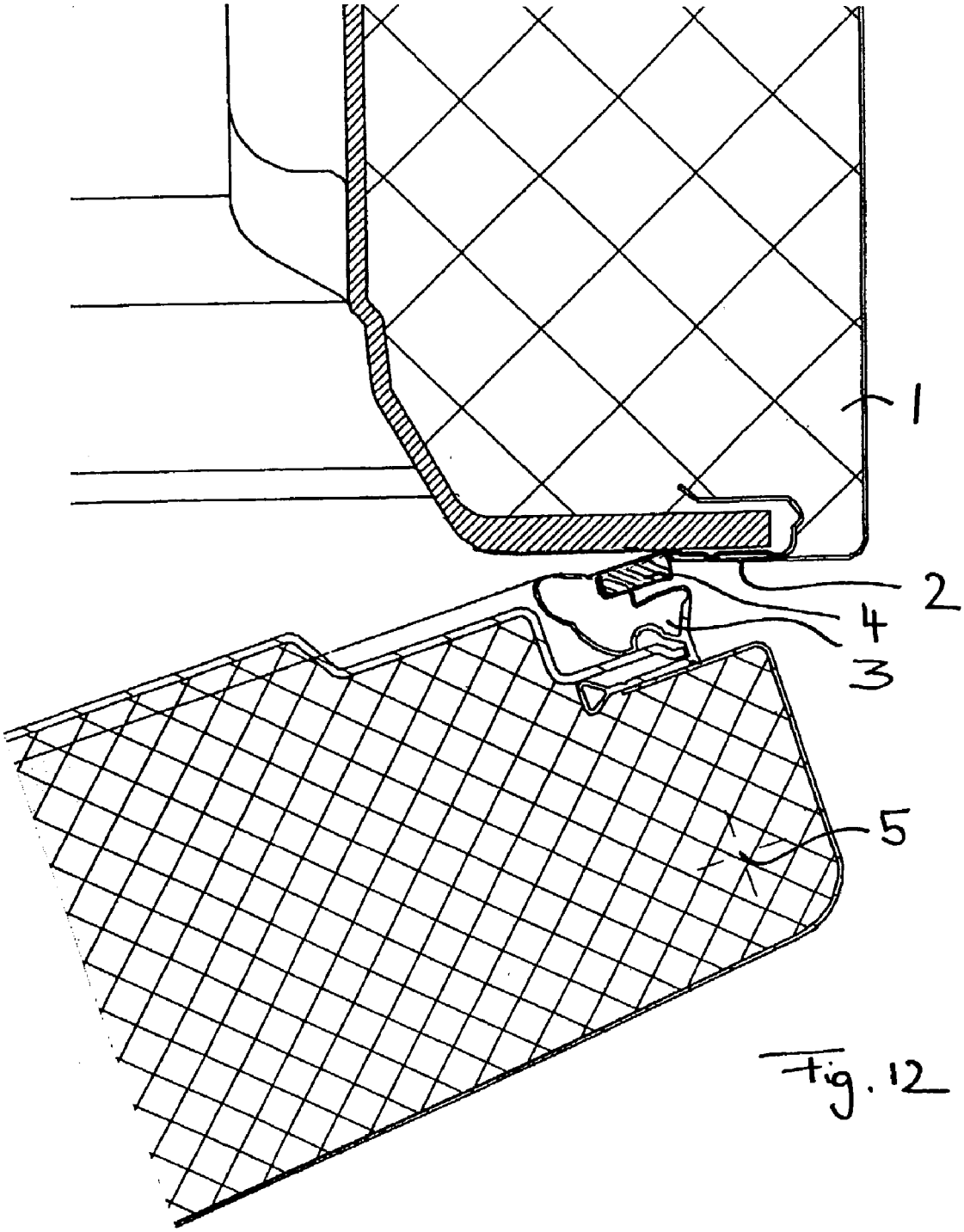
FIG. 12 shows a horizontal section through a refrigerator of prior art similar to FIG. 11 wherein the door is shown in a slightly opened position.
Figure 13:
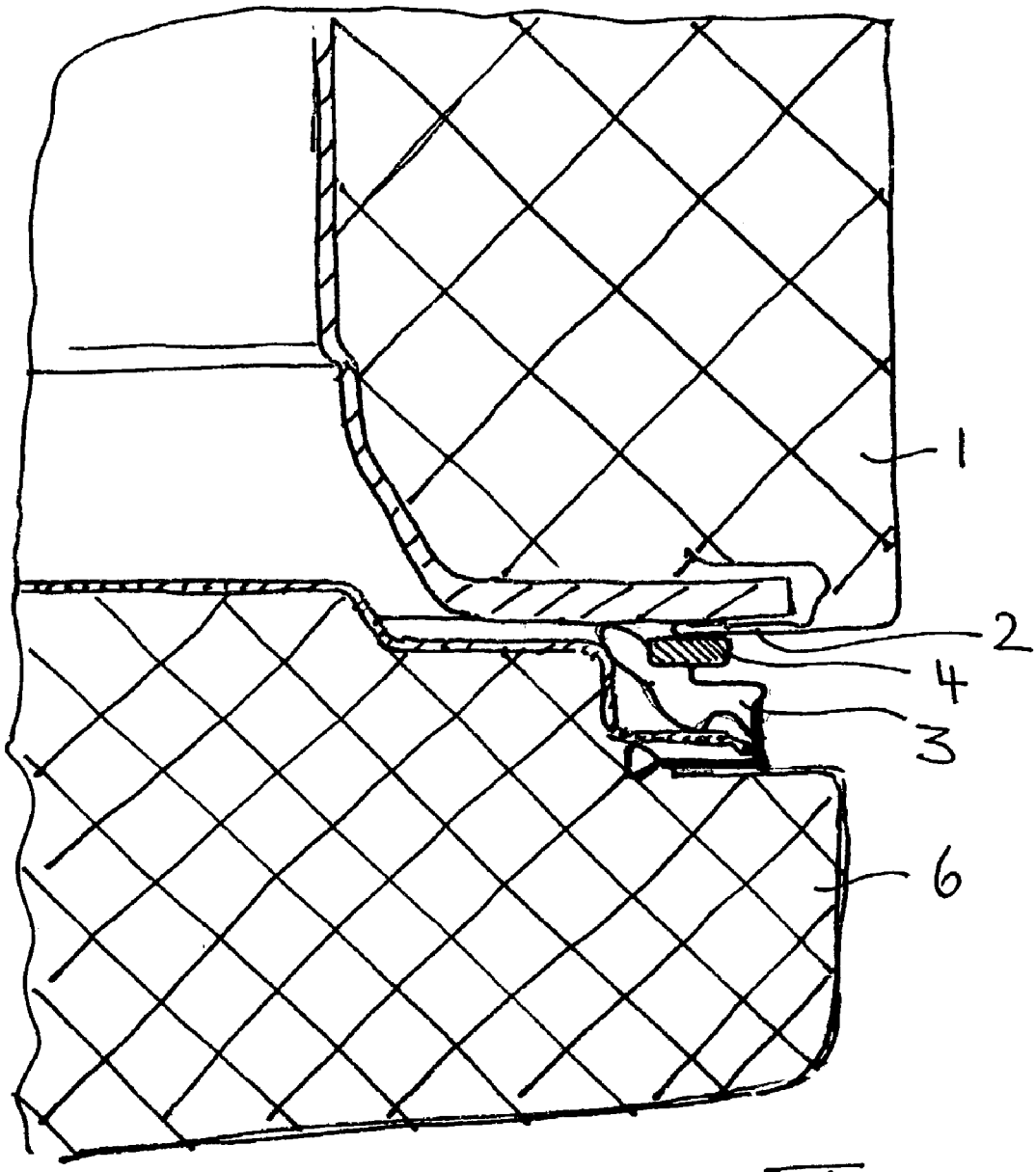
FIG. 13 shows a horizontal section through a refrigerator of prior art similar to FIGS. 11 and 12 wherein the gasket is shown in a flexed, displaced contact position.

Another embodiment of the door arrester is shown in FIG. 10 which essentially corresponds to the embodiment of FIGS. 8 and 9. The door arrester 27 here is also of a two-part design. The first door arrester section 28 is rigidly connected with door 6, specifically as in the embodiments described previously on the top side of the door. Its side facing appliance body 1 with the door closed is designed analogously as cam 17. In place of the previously described drawer-like slot 26, door arrester 27 has a longitudinal groove 29 open on the top side in which the second door arrester section 30 sits longitudinally with precise fit and is arranged to be longitudinally displaceable (FIG. 10). A spring 32 located in a first spring receptacle compartment 31 of door arrester section 28 pretensions second door arrester section 30 toward the exterior of the door. As in the embodiments described previously, hinge pin 10 is able to pass through door arrester 27 and engage elongated hole 15 within the top side of door 6. Otherwise the function of door arrester 27 matches the previously described embodiment.

The additional axis of motion of the door perpendicular to pivot axis 5 and, with the door closed, perpendicular to sealing interface 2 in connection with the cam device prevents any flexure of gasket 3. Gasket 3 always meets, and is lifted from, sealing contact surface 2 of body 1 essentially vertically. Defective sealing is prevented and the life considerably lengthened due to the flexure-free closing and opening processes.

The invention claimed is:

1. A cooling appliance device having an appliance body (1) and a door (6) structured and arranged for closing and opening the appliance body (1), wherein the door (6) is pivotally supported relative to the appliance body (1) about a pivot axis (5), the door (6) relative to the pivot axis (5) is movably mounted in a direction perpendicular to length or axial direction of the pivot axis (5), and additionally comprising at least one door arrester (11, 22, 27) rotationally arranged on the pivot axis (5), the door (6) fastened to the door arrester (11, 22, 27) which has elastic door arrester sections located on the pivot axis (5) which are pretensioned by a spring relative to the door (6) in a direction of a door side facing away from the appliance body (1), said door arrester (11; 24, 24) having a first holder section (13; 23) rigidly connected to the door (6) and a second holder section (12; 24) rotatably holding the pivot axis (5), said second holder section (12; 24) being movable relative to said first holder section (13; 23) in a direction perpendicular to a plane defined by the door and the second holder section (12; 24) being pretensioned by said spring relative to the first holder section (13; 23) in a direction perpendicular to the door plane and away from the door side facing the appliance body (1) to urge the door (6) towards the appliance body (1).

2. A device according to claim 1, additionally comprising a motion control device (17, 21) structured and arranged for controlling motion of the door (6) transverse to the pivot axis (5) when the door (6) is opened or closed.

3. A device according to claim 1, additionally comprising a cam device (17, 21) between the appliance body (1) and door (6), which cam device defines, as a function of pivot position of the door (6), distance of the door (6) from the appliance body (1) in a region of the pivot axis (5).

4. A cooling appliance device having an appliance body (1) and a door (6) structured and arranged for closing and opening the appliance body (1), wherein the door (6) is pivotally supported relative to the appliance body (1) about a pivot axis (5), the door (6) is movable relative to the pivot axis (5) in a direction substantially perpendicular to a plane defined by either the door (6) or by an opening in the appliance body (1) which is closable by the door (6), additionally comprising a cam device (17,21) between the appliance body (1) and door (6) which defines, as a function of pivot position of the door (6), distance of the door (6) from the appliance body (1) in a region of the pivot axis (5), the cam device (17,21) having a cam (17) in turn having a first curved surface section (19) structured and arranged to allow positioning of the door (6) close to the appliance body (1) upon a completely closed pivoting position of the door (6), and second curved section (20) adjoining the first curved section (19) and structured and arranged to effect a distant position of the door (6) perpendicularly or translationally away from the opening plane on the appliance body (1) upon removal of the door (6) from the appliance body (1), a spring device (12, 25, 32) structured and arranged to pretension the pivot axis (5) relative to the door (6) in the direction substantially perpendicular to the door or opening plane to urge the door (6) towards the appliance body (1) such that a pretensioning force is greater than sealing forces acting between the door (6) and appliance body (1), and the cam device (17, 21) additionally comprising a support pin (21) structured and arranged such that the spring device (12, 25, 32) urges the door (6) toward the appliance body (1) in a direction perpendicular to length of the pivot axis (5), with the support pin (21) being urged into snug fit with the cam (17) and reliably falls into the first curved section (19) of the cam (17) which is in the shape of a sink, wherein the support pin (21) moves along the first and second curved sections (19, 20) of the cam (17) surface to effect movement of the pivot axis (5) against the force of the spring (12, 25, 32) in the direction substantially perpendicular to the door plane or the appliance opening plane.

5. A device according to claim 4, wherein the cam device (17, 21) and spring device (11, 25, 32) form an automatic closing device which effects an automatic closing of the door (6) in an end region of pivot motion of the door (6).

6. A device according to claim 1, wherein the pivot axis (5) is formed by two coaxially aligned hinge pins (10), rigidly fixed to the appliance body (1), and the appliance door (6) is movably mounted translationally relative to the pivot axis (5) by a pivot axis guide (15) provided on the door (6) and having elongated hole-shaped bearing slots (15) in which the pivot axis (5) is routed.

7. A device according to claim 1, wherein the at least one door arrester (11, 22, 27) and a cam device (17) form an assembly unit.

8. A device according to claim 1, wherein a cam (17) having a curved surface (18) facing the appliance body (1) is rigidly fixed to the door (6) and the at least one door arrester (27) has a guide (28, 29) mounted displaceably perpendicular to front and rear sides of the door (6).

9. A device according to claim 1, wherein a cam (17) comprises a curved control surface (18) facing the appliance body (1) and is rigidly fixed to the door (6) and of an integrated one-piece design, the at least one door arrester (11) structured and arranged to sit on the pivot axis (5), and comprising a spring section between the curved control surface (18) and one of the door arrester sections (12).

10. A device according to claim 1, additionally comprising projecting hinge plates (9) rigidly fixed to the appliance body (1), one hinge pin (10) and one support bearing each are rigidly fixed to the hinge plates (9).

11. A device according to claim 4, wherein the cam is made of plastic.

12. A device according to claim 2, wherein the motion control device (17, 21) is structured and arranged to control motion of the door (6) essentially perpendicular towards or away from the appliance body (1) at an end of pivot-closing or a beginning of pivot-opening.

13. A device according to claim 3, wherein the cam device (17, 21) has a cam (17) in turn having a first curved section (19) structured and arranged to allow positioning of the door (6) close to the appliance body (1) upon a completely closed pivoting position of the door (6), and a second curved section (20) adjoining the first curved section (19) and structured and arranged to effect a distant position of the door (6) perpendicularly or translationally away from a plane defined by the appliance body (1) upon removal of the door (6) from the appliance body (1).

14. A device according to claim 8, wherein the cam (17) additionally comprises a spring slot (26, 31) structured and arranged to accommodate the spring (25, 32).

15. A device according to claim 9, wherein the curved control surface (18) and door arrester section (12) together define an approximately U-shaped contour.

16. A device according to claim 10, wherein the support bearing is constituted by a bearing pin (21) mounted substantially parallel to the hinge pin (10), and additionally comprising a cam sliding surface (18) provided on a door side and resting upon the support bearing pin (21).

17. A device according to claim 1, wherein the appliance is at least one of a refrigerator and freezer.

18. A device according to claim 4, wherein the appliance is at least one of a refrigerator and freezer.

* * * * *